United States Patent [19]

Gray, III

[11] Patent Number: 4,569,632

[45] Date of Patent: Feb. 11, 1986

[54] BACK-SKEWED FAN

[75] Inventor: Leslie M. Gray, III, Belmont, Mass.

[73] Assignee: Airflow Research and Manufacturing Corp., Watertown, Mass.

[21] Appl. No.: 549,988

[22] Filed: Nov. 8, 1983

[51] Int. Cl.[4] ..... F04D 29/38

[52] U.S. Cl. ..... 416/189; 416/DIG. 2; 416/238

[58] Field of Search ..... 416/238, 189 R, 192, 416/228 R, 245 B, DIG. 2

[56] References Cited

U.S. PATENT DOCUMENTS

| | | | |
|---|---|---|---|
| 2,061 | 8/1865 | Tripp | 416/238 |
| 296,271 | 4/1884 | Pistoja | 416/238 |
| 345,761 | 7/1886 | Bennett | 416/DIG. 2 |
| 1,593,516 | 7/1926 | Sutter | 416/238 |
| 1,991,095 | 2/1935 | Hochstetter | 416/238 |
| 2,043,736 | 6/1936 | Charavay | 416/238 |
| 2,709,035 | 5/1955 | Schmidt | 416/93 R X |
| 2,903,076 | 9/1959 | Johannesen | 416/189 R |
| 3,367,423 | 2/1968 | Van Ranst | 416/238 |
| 3,826,591 | 7/1974 | Wilson | 416/189 R X |
| 4,329,946 | 5/1982 | Longhouse | 416/189 R X |
| 4,358,245 | 11/1982 | Gray | 416/189 |
| 4,396,351 | 8/1983 | Hayashi et al. | 123/41.49 X |
| 4,459,087 | 7/1984 | Barge | 416/189 R X |
| 4,505,641 | 3/1985 | Tsuchikawa et al. | 416/189 R |

FOREIGN PATENT DOCUMENTS

| | | | |
|---|---|---|---|
| 19987 | 1/1930 | Australia | 416/238 |
| 516440 | 9/1955 | Canada | 416/242 |
| 41498 | 3/1982 | Japan | 416/93 R |
| 91925 | 4/1938 | Sweden | 416/DIG. 2 |
| 10578 | of 1893 | United Kingdom | 416/192 |
| 1325395 | 8/1973 | United Kingdom | 416/189 R |
| 2080046 | 1/1982 | United Kingdom | 416/169 A |
| 433064 | 1/1976 | U.S.S.R. | 416/93 A |
| 732580 | 5/1980 | U.S.S.R. | 416/DIG. 2 |

*Primary Examiner*—Everette A. Powell, Jr.

[57] ABSTRACT

A compact, efficient axial flow fan with blades that are rearwardly (i.e., away from the direction of fan rotation) skewed and which are oriented at a pitch ratio which continuously decreases as a function of increasing blade radius along the radially outermost 30% of the blade.

8 Claims, 8 Drawing Figures

FIG 1
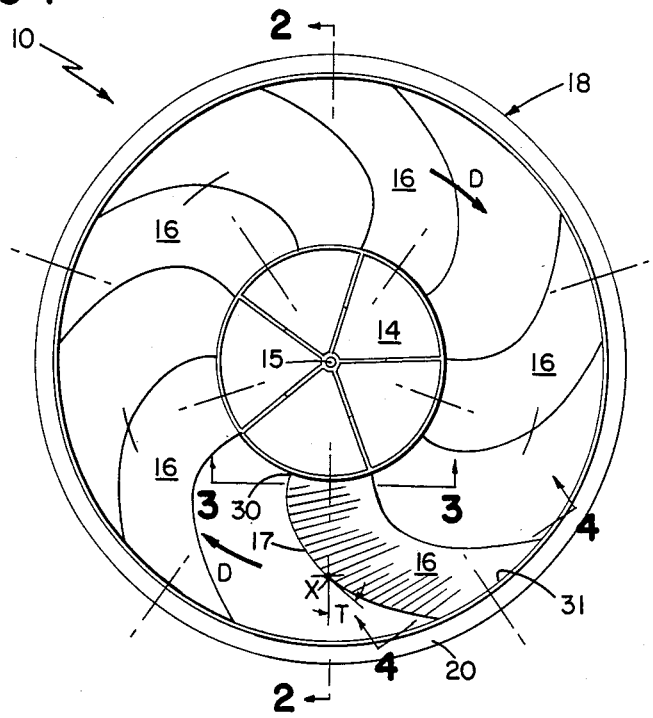
FIG 2
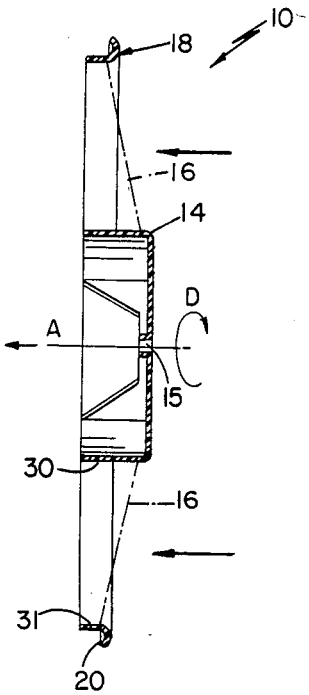
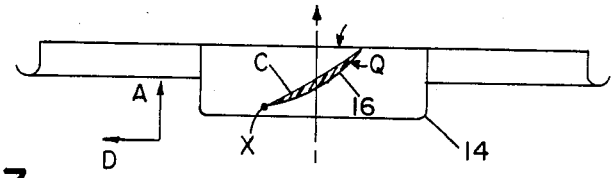
FIG 3
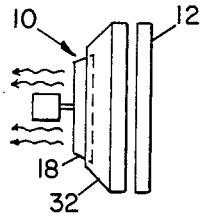
FIG 7
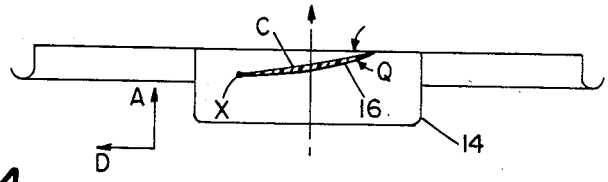
FIG 4
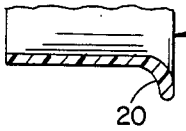
FIG 8
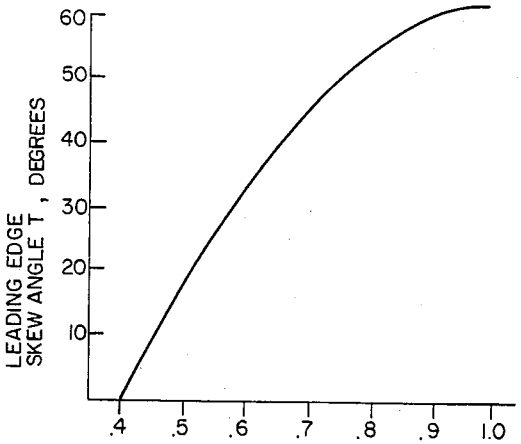
FIG 5
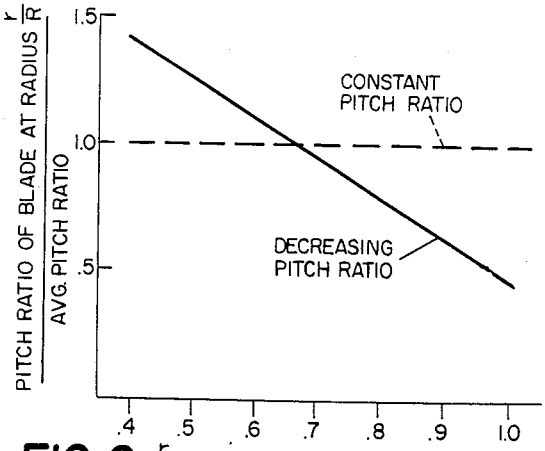
FIG 6

BACK-SKEWED FAN

BACKGROUND OF THE INVENTION

This invention relates to axial flow fans, for example, fans designed for operation in the flow exiting a heat exchanger or in free air (e.g., a room fan).

Axial flow fans generally have a set of blades, each of which is secured at a root end to a hub that is driven by a rotating shaft and from which the blade extends radially outwardly. The blades are generally "pitched" at an angle to the plane of fan rotation to generate an axial air flow as the blades rotate.

Fan designs must accommodate a number of diverse considerations. For example, automotive fans situated behind a radiator should be compact (due to space limitations in the engine compartment), efficient (avoiding wasted energy which directs air in turbulent flow patterns away from the desired axial flow), relatively quiet, and strong (to withstand the considerable forces generated by air flows and centrifugal forces).

Generally fan blades are "unskewed"; that is, a radial center line of the blade is straight, and the blade chords perpendicular to that line are uniformly distributed about the line.

In one fan described in my U.S. Pat. No. 4,358,245, which is hereby incorporated by reference, the fan blades are highly forwardly skewed, i.e., the blade center line curves in the direction of fan rotation as it extends from the root to the tip of the blade. The blade angle in the fan disclosed in U.S. Pat. No. 4,358,245 increases over the outer 30% of the blade.

Applicant is aware of some fans which use backwardly-skewed blades. For example, General Motors Corporation has used a fan with a modest backward skew on its "X-Car". The blade angle of that fan increases with increasing diameter along the outer portion of the blades, and the skew angle at the blade tip is approximately 40 degrees. Other fans with back-skewed blades include room fans or transformer cooling fans, which also have an increasing blade angle with increasing diameter, and which generally do not have an outer ring or band connecting the blade tips.

Various fans employ an outer ring or band which is coaxial with the hub and is secured to the outer ends of the blades. For example, my above-mentioned U.S. Pat. No. 4,358,245 shows such a ring, as do other patents described therein.

SUMMARY OF THE INVENTION

The invention features a fan with an outer band attached to the tip of the blades, and with blades that are rearwardly (away from the direction of fan rotation) skewed and oriented at a pitch ratio which continuously decreases as a function of increasing blade radius along the radially outermost 30% of the blade. For purposes of this application: (1) the extent of skew at a given point X along the leading edge of the blade can be expressed by the skew angle (T) which is the angle between a line tangent to the leading edge at point X and a line from the center of the hub to point X; and (2) the pitch at a given radius r from the center of the hub is described by a non-dimensional pitch ratio (i.e. the ratio of pitch to fan diameter) which is equal to $2\pi$ r/R.tanQ where R is the radius of the fan from the center of the hub to the tip of the blade, and Q is the blade angle (see FIGS. 3 and 4), i.e., the angle between the plane of fan rotation D and a blade section at the radius r. [Another way to describe a given location on the blade is its non-dimensional radius (r/R).]

In preferred embodiments, the blade skew angle is at least 50 degrees at the blade tip, and at least 25 degrees at a non-dimensional radius of 0.70. Also in preferred embodiments, the blade pitch ratio decreases continually and the blade skew angle increases continually along the entire segment of the blade where r/R is greater than 0.7.

The invention makes possible a compact fan configuration which exhibits reduced noise and is at the same time efficient. Specifically, the relatively high back skew is effective to control noise. To accomodate this backskew and thus maintain efficiency and compactness while maintaining acceptable noise control, the fan design controls the pitch along the outer blade in a manner that is consistent with noise control and compactness. Thus, for applications with a fixed requirement as to the distance from the heat exchanger to the effective rear edge of the fan, the invention permits a relatively greater spacing between the outer leading edge of the blade and the heat exchanger, thus improving fan efficiency.

Other features and advantages of the invention will be apparent from the following description of the preferred embodiment and from the claims.

DESCRIPTION OF THE PREFERRED EMBODIMENT

Drawings

FIG. 1 is a plan view of the fan from the exhaust side.

FIG. 2 is a section along 2—2 of FIG. 1.

FIG. 3 is a section along 3—3 of FIG. 1.

FIG. 4 is a section along 4—4 of FIG. 1.

FIG. 5 is a graph depicting leading edge skew as a function of the non-dimensional radius.

FIG. 6 is a graph depicting pitch ratio at a given non-dimensional radius÷average pitch ratio as a function of the non-dimensional radius.

FIG. 7 is a schematic plan view of the fan with a heat exchanger and a shroud.

FIG. 8 is an enlargement of a section of the outer band shown in FIG. 2.

STRUCTURE

FIGS. 1–4 and 7–8 show a low-noise, compact, high efficiency fan 10 situated behind a heat exchanger 12. Fan 10 includes a centrally located cylindrical hub 14 with a plurality, e.g., five, blades 16 extending outwardly therefrom to a cylindrical outer rim or band 18.

An opening 15 in the center of the hub 14 accepts a shaft which mounts the fan for rotation around its central axis A. As depicted in FIG. 2, central axis A is directed away from heat exchanger 12, i.e., in the direction of air flow generated by the fan when it rotates in the direction of arrow D (clockwise when viewed from heat exchanger 12).

Outer band 18 encloses the blades and is generally centered on the axis of rotation of the fan. Each 16 blade extends from a root end 30 secured to the hub to an outer end 31 secured to the inner surface of band 18. The outer ends of the blades are joined to the band over the full width of the blades and not at a single point or over a narrowing connecting band. This form of connection is important in controlling the recirculation of the air from the high pressure working surface of the blades to the opposite low pressure side. It also assists in directing the air onto the working surface of the blades with a minimum of turbulance. Finally, the support provided by band 18 provides strength to the fan blade.

The fan may be used in conjunction with a conventional shroud 32 that extends between the radiator and the outer edge of the fan. The main purpose of the shroud is to prevent the recirculation of air around the outer edge of the fan to the low pressure region at the opposite side of the fan adjacent to the radiator. Such a circulation may cause separation of the flow of the fan and an attendant increase in the noise level.

As shown in FIG. 1, each blade is rearwardly skewed in that a longitudinal center line drawn through the midpoints of chords is curved in a direction (root-to-tip) that is opposite to the direction of rotation D.

As described above, for purposes of this application, "skew" refers to the skew of the leading edge of the blade. At a point X on the leading edge 17 of blade 16, the skew angle is the angle T between a tangent to edge 17 through X and a line from the center of opening 15 (i.e., the center of the fan) through X.

As shown in FIG. 1, the blade is increasingly backskewed as a function of movement from root to tip. Specifically, it has been determined that the radially outer 30% of the fan blade is the most important blade segment as regards noise reduction. In this outer 30% region, the amount of backskew increases. For example, the skew angle T is preferably greater than 25 degrees at r/R=0.7; beyond that point (e.g. r/R is larger than 0.70), the skew angle T (in degrees) increases and is greater than 50 degrees at the blade tip. The table below and FIG. 5 show a typical relationship between the non-dimensional radius and the skew angle on the leading edge.

The above-described backskew is taken into account in designing the pitch of the blade. Pitch ratios which are effective for fans with unskewed or forwardly skewed blades are not necessarily effective for banded fans with rearwardly skewed blades, because of the three dimensional flows on the blade surface induced by the rearward skew, and because of the presence of the band attached to the blade tip. For example, a pitch ratio which is relatively constant with increasing non-dimensional radius is effective for unskewed fans, and a pitch ratio which sharply increases with increasng non-dimensional radius is effective for forwardly skewed fans. In contrast, a backwardly skewed blade is more effective when the pitch ratio at the blade tip is reduced in proportion to the amount of backskew. It is advantageous, therefore, to use the skew and pitch ratio relationships described herein concurrently, and the pitch ratio should decrease along the outer 30% of the blade. The table below and FIG. 6 show a typical relationship between the non-dimensional radius and the ratio of pitch ratio at r/R to average pitch ratio.

While the dimensions and configurations of the fan 10 will vary depending upon its application, the following dimensions describe a preferred form of the invention suitable for use behind a heat exchanger. The fan 10 has a maximum outer diameter of approximately 368 mm. The inner diameter of the band has a value of 343 mm at its widest point. The hub 14 has a diameter of approximately 140 mm, and each blade therefore has a total radial length of approximately 101 mm. Each blade has a chord width approximately 62 mm. The chord-to-diameter ratio is thus about 0.18 along the entire length of the blade, and the blade-thickness-to-chord-length ratio is approximately 0.061 along the entire length of the blade.

TABLE OF FAN PARTICULARS

| Non-Dimensional Radius | Pitch Ratio | Blade Angle Degrees | Camber to Chord Ratio | Leading Edge Skew Angle |
|---|---|---|---|---|
| .4 | .9 | 35.6 | .095 | 0 |
| .5 | .94 | 30.9 | .093 | .8 |
| .6 | .90 | 25.5 | .089 | 33 |
| .7 | .85 | 21.1 | .082 | 44 |
| .8 | .76 | 16.8 | .077 | 53 |
| .9 | .64 | 12.8 | .070 | 60 |
| 1.0 | .47 | 8.5 | .060 | 61 |

These dimensions and other values are provided by way of illustration but not of limitation. Specifically, the leading edge skew angle (T) as a function of r/R is shown in FIG. 5. Angle T is greater than 50° at the blade tip and greater than 25° at r/R=0.7. Preferably, angle T continually increases as r/R increases. The pitch ratio/average pitch ratio depicted in FIG. 6 may be varied, but it should continually decrease as a function of r/R along the portion of the blade where r/R is above 0.7.

Maintaining the pitch and skew angle in the above-mentioned preferred ranges provides for reduced noise and proper loading of the fan blades, and provides an increased spacing between the leading edge of the outer blade segments and the heat exchanger.

The above-described fan and a fan system (a fan and shroud combination) are particularly suited for use in a turbulent air flow with a significant reduction in the noise output of the fan as compared to unskewed fans. The fan is also characterized by a good operating efficiency. These operational improvements are achieved through a combination of features. An outer band secured across the full width of a set of blades which are each backwardly skewed. The backward skew enables a relatively low-noise blade design that features the greatest pitch near the blade root, with decreasing pitch over the outer 30% of the blade. As a result of this design, the blade's effective width in the direction of air flow is smaller at the outer blade ends than at the root, and the distance between the forward edge of the outer blade and a heat exchanger in front of the fan is thereby increased. Thus the blade is more efficiently shrouded to the heat exchanger because the path of air forced through the edges of the heat exchanger and along the shroud radially inwardly to the outer blade edge is less tortuous due to the increased blade-to-exchanger spacing. The resulting fan can exhibit a 20% increase in efficiency over an unskewed fan, and a 6 dBA reduction in noise.

The band also improves fan efficiency. Besides adding structural strength to the fan by supporting the blades at their tips, the band holds the air on the working surface of the blades, and in particular prevents the air from flowing from the high pressure side of the blades to the low pressure side by flowing around the outer ends of the blades. The band preferably has a cross-sectional configuration that is thin in the radial direction while extending in the axial direction a distance at least equal to the axial width of the blades at their tips. As shown in FIG. 8, the inner radius of the band 18 varies in the axial direction. More specifically, it has a maximum value at the front edge of the fan and rapidly decreases to provide a nozzle effect that accelerates an airflow passing through the band. After this initial narrowing, the inner wall of the band has a generally constant radius. The front end narrowing is provided by an out-turned lip portion 20 of the band.

While the blades can be formed of a flat sheet material that is twisted end for end to have the required variation in pitch, each blade preferably has an airfoil cross-section as is best seen in FIG. 3 and 4. In addition, each blade preferably is cambered to distribute the load over the chord of the blade in an effective fashion. The leading edge of each blade is characterized by a generally rounded configuration and the trailing edge tapers to a narrow edge. In its preferred form, the thickness of the blade at its center is at least 4% of the blade chord.

While the various components of the fan described above can be manufactured separately and assembled to form the fan, in the preferred form the fan is formed as a single, integral unit. More specifically, the fan is preferably formed of a high-strength plastic material which can be injection molded. A suitable material is glass-filled nylon or polypropylene. In addition, molding from plastic provides a fan which has low weight and low cost as compared to a comparable structure formed from skewed airfoil sectioned blades fabricated from metal.

While the invention has been described with respect to its preferred embodiment, it should be understood that various alterations and modifications are possible without departing from the scope of the present invention. For example, the blades can be formed from the flat sheet material which does not have an airfoil cross-section or can be formed without any camber. It is, of course, possible to form the construction from other structural material such as sheet metal and to form it from multiple components which are assembled with suitable fastening means such as welds, adhesives, or rivets. Similarily, while the invention has been described with reference to a funnel-like shroud which is disposed between the fan and a source of turbulent air, other structures such as orifice plates can be used to provide the same function.

These and other variations and modifications will occur to those skilled in the art from the foregoing detailed description and the accompanying drawings.

I claim:

1. A cooling fan, means for maintaining said fan in association with a heat exchanger in position to pass cooling air through said heat exchanger, said fan comprising a hub rotatable on an axis, a plurality of plastic blades, each of which extends radially outward from a root region attached to said hub to a tip region, and a cylindrical band extending concentrically around said fan axis, said band connecting said blade tip regions, said blades:

(a) being rearwardly skewed away from the direction of fan rotation; and (b) being oriented at a pitch ratio which continually decreases as a function of increasing blade radius along the radially outermost 30% of said blade, said pitch ratio being equal to $2\pi r/R.\tan Q$ where R is the total fan radius, r is the radius of a given point on the blade and Q is the blade angle at point r.

2. The fan of claim 1 wherein the blade skew angle (T) is at least 50 degrees at said tip.

3. The fan of claim 1 wherein the blade skew angle (T) is at least 25 degrees at a non-dimensional radius of 0.70.

4. The fan of claim 1 wherein said means for maintaining said fan in association with a heat exchanger is a means for positioning said fan upstream from said heat exchanger to blow air through said heat exchanger.

5. The fan of claim 1 wherein said fan comprises at least four said blades.

6. The fan of claim 1 wherein the skew angle increases continually along the segment of the blade where r/R is greater than 0.7.

7. The fan according to claim 1 wherein said fan is formed as an integral structure.

8. The fan according to claim 1 wherein said integral structure is formed of a molded plastic material.

* * * * *